US010413024B2

(12) United States Patent
de Andrade

(10) Patent No.: US 10,413,024 B2
(45) Date of Patent: Sep. 17, 2019

(54) FASTENING STRUCTURE

(71) Applicant: Fabio de Andrade, Lee's Summit, MO (US)

(72) Inventor: Fabio de Andrade, Lee's Summit, MO (US)

( * ) Notice: Subject to any disclaimer, the term of this patent is extended or adjusted under 35 U.S.C. 154(b) by 0 days.

(21) Appl. No.: 15/639,323

(22) Filed: Jun. 30, 2017

(65) Prior Publication Data

US 2018/0008014 A1 Jan. 11, 2018

Related U.S. Application Data

(63) Continuation of application No. 15/202,306, filed on Jul. 5, 2016, now Pat. No. 9,700,107.

(51) Int. Cl.

| | |
|---|---|
| ***A44B 99/00*** | (2010.01) |
| ***A43C 9/00*** | (2006.01) |
| ***A43B 3/24*** | (2006.01) |
| ***A43B 11/00*** | (2006.01) |
| ***A43C 11/00*** | (2006.01) |
| ***A43C 11/12*** | (2006.01) |
| *A41F 1/00* | (2006.01) |
| *A44B 19/16* | (2006.01) |

(52) U.S. Cl.

CPC ..... *A44B 99/00* (2013.01); *A43B 3/244* (2013.01); *A43B 11/00* (2013.01); *A43C 9/00* (2013.01); *A43C 11/00* (2013.01); *A43C 11/008* (2013.01); *A43C 11/12* (2013.01); *A41F 1/008* (2013.01); *A44B 19/16* (2013.01); *Y10T 24/44043* (2015.01); *Y10T 24/44077* (2015.01)

(58) Field of Classification Search

CPC ..... A44B 99/00; A44B 19/16; A43C 9/00; A43C 11/00; A43C 11/008; A43C 11/12; A41F 1/008; Y10T 24/44077; Y10T 24/44043

See application file for complete search history.

(56) References Cited

U.S. PATENT DOCUMENTS

| | | | |
|---|---|---|---|
| 2,519,108 | A | 8/1950 | Bryant et al. |
| 2,857,688 | A | 10/1958 | Haase et al. |
| 2,871,539 | A | 2/1959 | Swan et al. |

(Continued)

FOREIGN PATENT DOCUMENTS

| | | | |
|---|---|---|---|
| CN | 1953677 | A | 4/2007 |
| CN | 101896085 | A | 11/2010 |
| WO | 2012066363 | A1 | 5/2012 |

OTHER PUBLICATIONS

PCT Application No. PCT/US2016/041081, International Search Report and Written Opinion, dated Sep. 26, 2016, 9 pages.

(Continued)

*Primary Examiner* — Victor D Batson
*Assistant Examiner* — Matthew J Sullivan
(74) *Attorney, Agent, or Firm* — Lathrop Gage L.L.P.

(57) ABSTRACT

Disclosed herein is a fastening structure which enables objects to be easily removeably coupled, and enables a smooth slideable coupling and decoupling. The fastening structure includes a male and female component. The male component is cross shaped with a wing member and cross bar member. The female component has a complementary structure with an elongate slot and cross groove, such that the male component is slideably received and mated.

16 Claims, 8 Drawing Sheets

(56) References Cited

U.S. PATENT DOCUMENTS 3,204,346 A * 9/1965 Lockard ..... A43B 3/24 36/101
4,507,878 A * 4/1985 Semouha ..... A43C 11/008 24/68 SK
5,217,001 A 6/1993 Nakao et al.
5,471,684 A * 12/1995 Casale ..... A42B 1/064 2/10
5,791,810 A 8/1998 Williams et al.
6,003,212 A 12/1999 Imahata
6,786,641 B2 * 9/2004 Plourde ..... B65D 33/2591 24/400
7,536,758 B2 5/2009 Meager
8,327,464 B2 * 12/2012 Jaros ..... A41F 1/00 2/243.1
9,700,107 B1 * 7/2017 de Andrade ..... A43C 9/00
2002/0178555 A1 * 12/2002 Tsai ..... B65D 5/6611 24/572.1
2006/0112596 A1 * 6/2006 Chan ..... A43B 3/103 36/100
2006/0165316 A1 * 7/2006 Cheung ..... B65D 33/2508 383/63
2006/0165317 A1 7/2006 Gzybowski
2007/0017072 A1 1/2007 Serio et al.
2010/0263171 A1 * 10/2010 Paik ..... A44B 11/25 24/194
2011/0054435 A1 3/2011 Kline et al.
2012/0246972 A1 * 10/2012 Newkirk ..... A43C 11/004 36/50.1
2013/0000089 A1 1/2013 Lee et al.
2014/0259571 A1 * 9/2014 Blythe ..... A44B 19/62 24/585.1
2015/0313323 A1 * 11/2015 Domanski ..... A44B 19/16 24/400

OTHER PUBLICATIONS

PCT Application No. PCT/US2016/041081, International Search Report and Written Opinion, dated Oct. 5, 2016, 13 pages.
Taiwan Application No. 105122769, Search Report dated Aug. 23, 2017, 1 page.
Taiwan Application No. 105122769, Office Action dated Aug. 24, 2017, 14 pages.

* cited by examiner

FASTENING STRUCTURE

RELATED APPLICATIONS

This application is a continuation application of, and claims priority to, U.S. application Ser. No. 15/202,306, filed Jul. 5, 2016, which is incorporated by reference herein in its entirety.

BACKGROUND OF THE INVENTION

The present invention relates, in general, to fastening structures and, more particularly, to a fastening structure which enables two objects to be easily coupled to and removed from each other. Generally, a variety of fastening means, such as double-sided tape, Velcro, Zip Lock, buttons, zippers, rivets, etc., for fastening a couple of objects to each other are known. Particularly, Velcro is widely used as representative means, along with because it is trouble-free and the installation of it is easy and it is easy to use. Velcro includes a first member which is provided with a plurality of locking hooks, and a second member which is provided with a plurality of catch loops. The first member and the second member are respectively installed on corresponding surfaces of objects and are fastened to or separated from each other depending on the coupling between the locking hooks and the catch loops. As a non-exhaustive list of objects would be straps for shoes, strollers, car seats and backpacks, sails, flexible membrane structures, tents, or any type of fabric that may have a space restriction.

However, none of these fasteners take into account a sliding mechanism that deals with axial tension issues that are created with the most stressful applications of the product design where performance of the components is located. Therefore, a fastening structure which can facilitate coupling or removal between first and second members by sliding means and deal with tension issues in equal or unequal measures is required.

BRIEF SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

The inventive device includes a male portion and a female portion that are releasably coupleable together. The male portion has a wing member upwardly extending to the top surface thereof and a cross member extending perpendicularly from the wing member. The female portion has an aperture extending through its top and a pair of perpendicular breaks or cross apertures that provide an opening through the front face of the female portion into the interior of the female portion. The aperture and the axial breaks define a groove of the female portion. The wing and cross members of the male portion having a front face that is slideably insertable in the groove of the female portion on the front face. The female portion having an outer surface that is circular in shape such that the female portion is a cylinder with an inner slot.

In one embodiment the fastening structure is coupled by force-fitting and is removed therefrom by pulling or by slideably mating or by snapping on or off or some combination of these.

In another embodiment, the front face of at least one first and second components is slanted at an angle traverse from longitudinal axis.

In another embodiment the first slideable male component further includes a second cross member and the second slideable female component contains a second cross aperture sized and shaped to mate with the second cross member.

In one embodiment, at least one of the male and female components further includes a retaining structure such that the retaining structure mates within a groove on the other respective component so as to lock the male and female components together in a locked configuration.

In one embodiment, the second slideable component further includes a stop situated on an opposed side from the front face, wherein the stop prevents further sliding of the first slideable component along the longitudinal axis with respect to the second slideable component.

The drawings constitute a part of this specification and include exemplary embodiments of the present invention and illustrate various objects and features thereof.

BRIEF DESCRIPTION OF THE DRAWINGS

A further understanding of the invention may be had by reference to the accompanying drawing in which.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. It is also noted that any reference to the words top, bottom, up and down, and the like, in this application refers to the alignment shown in the various drawings, as well as the normal connotations applied to such devices, and is not intended to restrict positioning of the connecting member assemblies of the application and cooperating bone anchors in actual use.

It will be appreciated that the figures teach by way of example and not limitation. The number of system components may be increased or decreased with respect to what is shown. Ideally, the top and bottom faces of each portion lie in substantially parallel planes to one another. The front and back faces of each portion lie in substantially parallel planes to one another. The side faces of each portion lie in substantially parallel planes to one another substantially perpendicular to the planes of the front and back faces. The planes of the front, back, and side faces extend substantially perpendicular to the planes of the top and bottom faces.

As best illustrated in FIGS. 1A, 2A-4A, in one embodiment, a fastener device 1 comprises a male component 10 and a female component 40 that are releasably coupleable together.

Figure 1A:
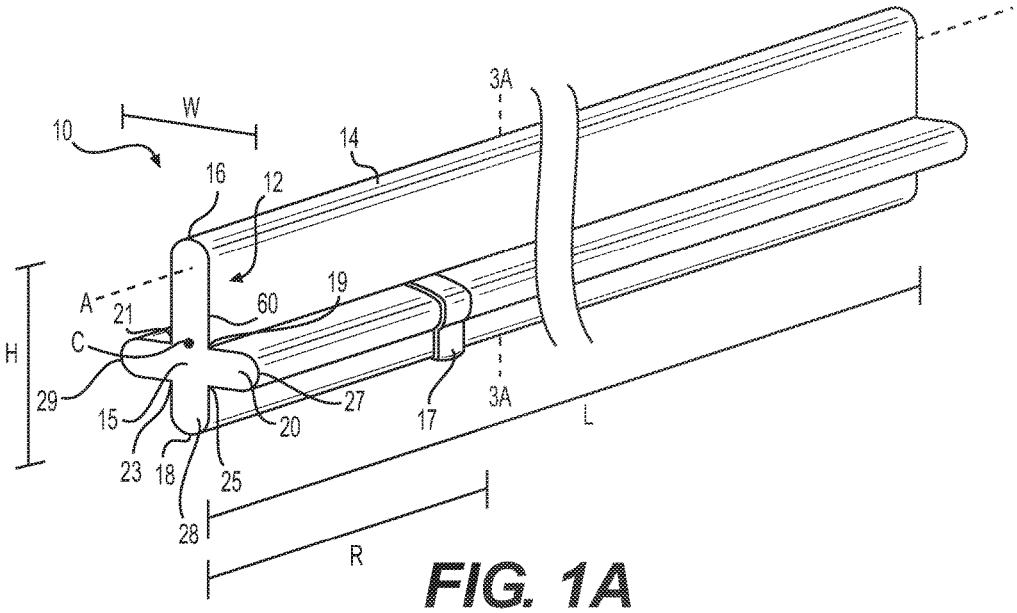
FIG. 1A is a top perspective view of the male component of the invention in a first embodiment.
Figure 3B:
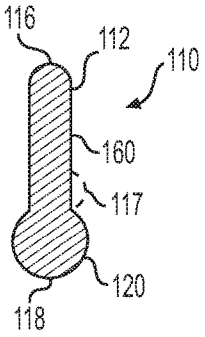
FIG. 3B is a cross sectional view of the male component of the invention in a third embodiment.
Figure 3A:
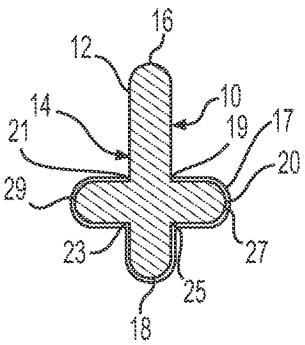
FIG. 3A is a cross sectional view of FIG. 1 taken along the line 3A-3A of the male component in the first embodiment.

Referring to FIGS. 1A and 3A, the male portion or component 10 includes flat planar front face 15. It is foreseen that the plane of the front face 15 may be at a slanted angle to allow for easier insertion of the male component 10. The male component 10 includes an elongate wing member 12 extending from a top 11 to a bottom 13 thereof. The wing member 12 extends about an axis A for a length L (FIG. 1). The wing member 12 includes a flat upper attaching portion 14 having an upper end 16 and a lower end 18. It is foreseen that the ends 16, 18 may be squared off, pointed, or other geometric shape than the rounded edges illustrated.

Located between the upper and lower ends 16, 18 is a protuberance or cross member 20 projecting laterally which serves as a stop or positioning guide for slideably positioning the female component 40 when being attached thereto. The cross member 20 creates edges 19, 21, 23, 25 where the cross member intersects the wing member 12. Like the wing member 12, the cross member 20 has side edges 27, 29 that may be squared off, pointed, or other geometric shape than the rounded edges illustrated. It is foreseen that the cross member 20 may be at various angles, for example making an arrow-shaped pointing upward or downward, or opposite where the cross member 20 may not create a mirror image on either side of the wing member 12. This means that the edges 19, 21, 23, 25 do not necessarily have to create an equal angle, i.e. 90 degrees. Edges 19, 21, 23, 25 may be rounded or curved or otherwise connected. The cross member 20 extends about the axis A for the length L. A thickness of the cross member 20 is illustrated as being substantially similar to a thickness of the wing member 12. It is foreseen that the thickness of the cross member 20 may be different from the thickness of wing member 12. In the illustrated example, the cross member 20 crosses the wing member 12 below a center C of the wing member 12, but it is foreseen that the cross member 20 may be above or below center C. The cross member 20 may be of a cross sectional dimension W that is equal or different to the height H of the wing member 12. In the illustrated example, dimension W is less than dimension H.

A retaining mechanism or resistance bar 17 is there to prevent easy pull-out of the male component 10 from the female component 40 and to resist or stop those tensional forces. The retaining mechanism 17 is located along a length R of the length L and follows the contours of the outer circumference of the cross member 20 and a bottom portion 28 of the wing member 12. The retaining member 17 is dimensionally sized to be larger than the cross member 20 and the wing member 12, and is sized and shaped to be mated within a groove 53 in the female component 40. It is foreseen that the retaining mechanism 17 may also be a bump, protuberance, hump, or bulge enough to create a tension lock that requires some force and expansion of the female component 40 to break the lock. It is also foreseen that the retaining structure may be a slot, groove, aperture, or the like with the mating structure on the female component instead of the male component as illustrated.

Figure 1B:
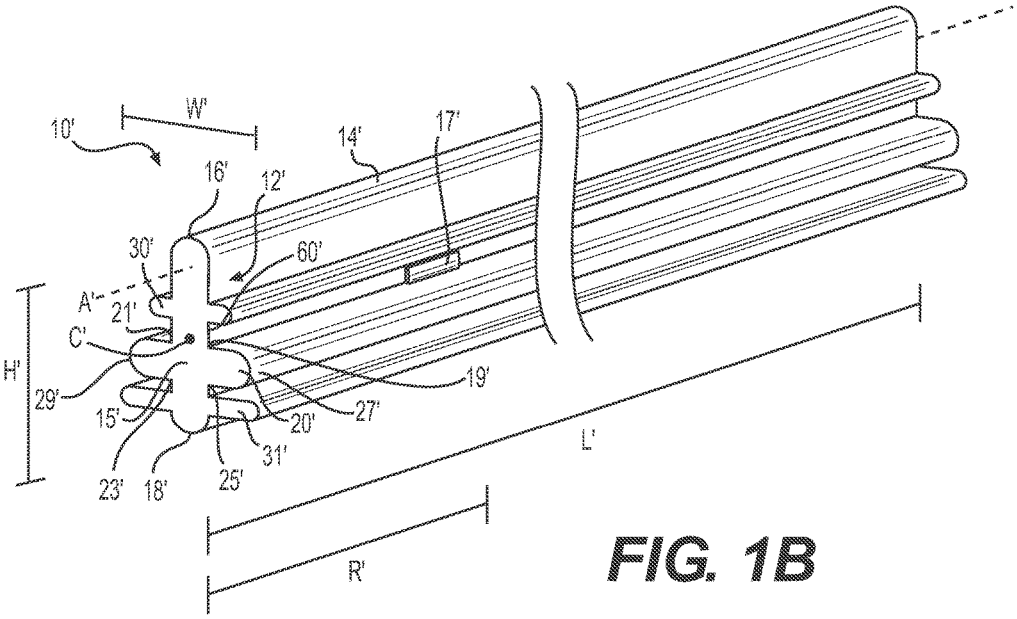
FIG. 1B is a top perspective view of the male component of the invention in a second embodiment.

Referring now to FIG. 1B, the male component 10' is substantially similar to male component 10, with the exception of cross members 30' and 31' and a bump 17'. It is also foreseen that the cross members 20', 30', 31' and bump 17' may be of a different dimension than what is illustrated. In the illustrated embodiment, cross member 30' is dimensionally shorter in width than cross member 20' and located above a center C' of a height H'. Cross member 31' is slightly longer in width than cross member 20' and located below the center C' of the height H'. The bump 17' is configured to create a tension lock that requires some force and expansion of the female component 40 to break the lock. It is foreseen that more than one bump 17' may be a part of the male component. It is also foreseen that the retaining member 17' may be a slot, groove, or aperture with the female component 40' having the mating structure to complement the retaining member 17'.

It is foreseen that the cross members 20', 30', 31' may be at various angles, for example making an arrow-shaped pointing upward or downward, or opposite where the cross members 20', 30', 31' may not create a mirror image on either side of the wing member 12'. The cross members 20', 30', 31' extend about the axis A' for a length L'. A thickness of the cross members 30', 31' is illustrated as being thinner than that of the wing member 12' and the cross member 20'. It is foreseen that the thickness of the cross members 30', 31' may be similar or larger than the thickness of wing member 12' or of cross member 20'. The cross bars 20', 30', 31' are there to prevent easy pull-out of the male component 10' from the female component 40' (FIG. 2B) and to resist or stop those tensional forces. It is also foreseen that there may be any number of cross members situated about the wing member.

Figure 2A:
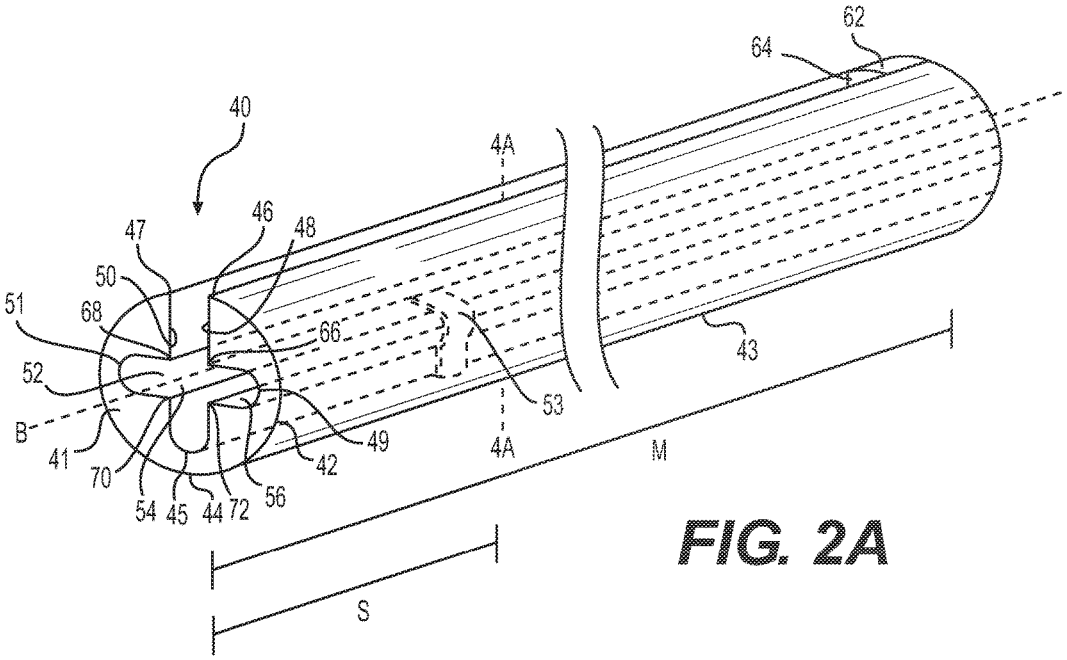
FIG. 2A is a top perspective view of the female component of the invention in the first embodiment.
Figure 4B:
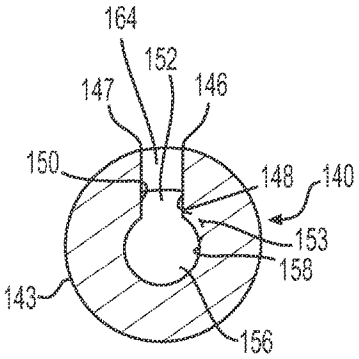
FIG. 4B is a cross sectional view of the female component of the invention in the third embodiment.
Figure 4A:
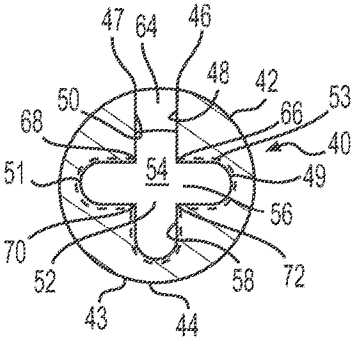
FIG. 4A is a cross sectional view of FIG. 2A taken along the line 4A-4A of the female component of the invention in the first embodiment.

Referring to FIGS. 2A and 4A, the elongate female component or strip 40 has a complementary construction to the male component 10. The female component has a circular outer surface 42 that extends about an axis B for a length M. It is foreseen that length M is substantially similar to length L (FIG. 2A). The female component 40 includes flat planar front face 41. It is foreseen that the plane of the front face 41 may be at a slanted angle to allow for easier insertion of the male component 10. The female component 40 includes a generally circular lower attaching portion 43 with a lower end 44 and upper free edges 46, 47. It is foreseen that the lower attaching portion 43 may be flat. The free edges 46, 47 are opposing two semi-cylindrical half portions 48, 50, which are separated by the free edges 46, 47 to form an elongate slot 52 perpendicular to the longitudinal axis B. The elongate slot 52 has an end 45. It is foreseen that the end 45 may be squared off, pointed, or other geometric shape than the rounded edges illustrated, so as to mate with the end 18 of the male component 10.

A groove or slot or cutout 53 is there to mate with retaining mechanism 17 to prevent easy pull-out of the male component 10 from the female component 40 and to resist or stop those tensional forces. The groove 53 is located along a length S of the length M and follows the contours of an internal space 54 which is mateably sized and shaped to mate with the outer circumference of the cross member 20 and a bottom portion 28 of the wing member 12. The groove 53 is dimensionally sized to be larger than the cross member 20 and the wing member 12, and is sized and shaped to be mated with the retaining mechanism of the male component 10.

The female component internal space 54 has internal dimensions substantially equal to the external dimensions of the male member 10. Located between the upper edges and lower edge 45, 46, 47 is a cross aperture, groove or slot 56 projecting laterally which serves as a positioning guide and mateably sized for slideably positioning the male cross member 20 when being attached thereto. The groove or slot 56 defines ends 49, 51 of internal surface 58. It is foreseen that the ends 49, 51 may be squared off, pointed, or other geometric shape than the rounded edges illustrated, so as to mate with the ends 27, 29 of the male component 10. The cross aperture 56 extends laterally from the slot 52 about the axis B for the length L'. It is foreseen that the cross aperture 56 may not extend the entire length of L'. A thickness of the cross aperture 56 is illustrated as being substantially similar to a thickness of the elongate slot 52. It is foreseen that the thickness of the cross aperture 56 may be different from the thickness of elongate slot 52. In the illustrated embodiment, the thickness of slots 52, 56 are substantially similar to the thickness of wing member 12 and cross member 20 of the male component, such that the male mateable fits within the female component 40.

It is foreseen that the cross aperture 56 may be above or below center of the elongate slot 52. It is also foreseen that there may be more than one cross aperture (FIG. 2B) situated either above or below the cross aperture 56, dependent upon whether or not the male component 10 has a like structure.

The female component 40 has a stop 62 with a stop surface 64 that would aid in preventing the further sliding of the male component back face moving past the female component back face (not shown).

Figure 2B:
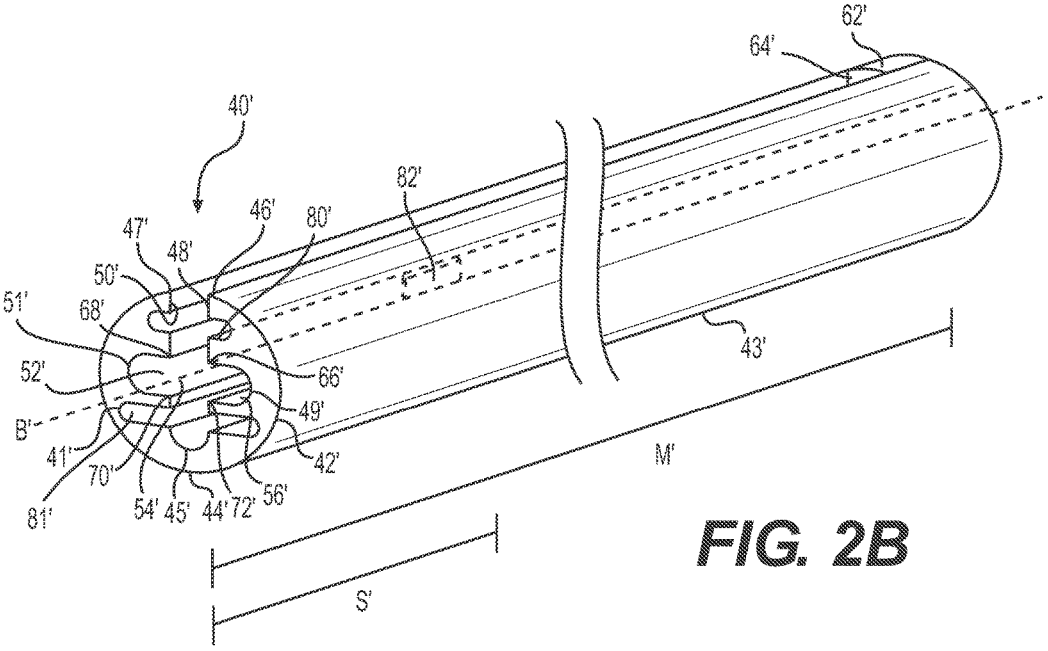
FIG. 2B is a top perspective view of the female component of the invention in the second embodiment.
Figure 7A:
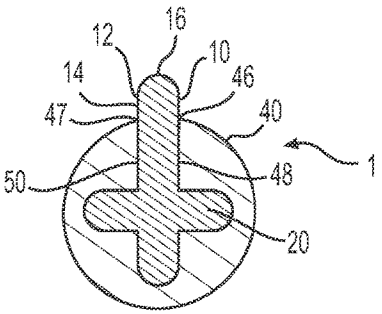
FIG. 7A is a cross sectional view of FIG. 5A taken along the line 7A-7A of the male and female components of the invention mated.
Figure 7B:
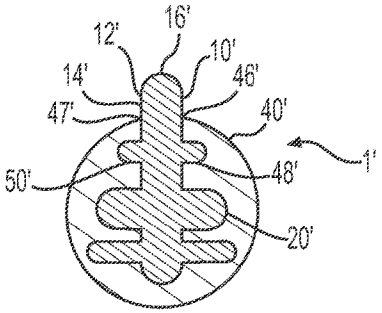
FIG. 7B is a cross sectional view of FIG. 5B taken along the line 7B-7B of the male and female components of the invention mated.

Referring to FIG. 2B, a second embodiment of the female component 40' is shown. The female component 40' is substantially similar to the female component 40, with the exception of cross apertures 80', 81' and slot or groove 53'. Located between the upper edges and lower edge 46', 47', 66', 68 is a cross aperture, groove or slot 80' projecting laterally which serves as a positioning guide and mateably sized for slideably positioning the male cross member 30' when being attached thereto. The cross apertures 80',81' extends laterally from the slot 52' about the axis B' for the length M'. It is foreseen that the cross apertures 56', 80', 81' may not extend the entire length of M'. In the illustrated embodiment, the thickness of slots 52', 56', 80', 81' are substantially similar to the thickness of wing member 12' and cross members 20', 30', 31' of the male component, such that the male mateable fits within the female component as seen in FIGS. 5B and 7B.

Figure 5A:
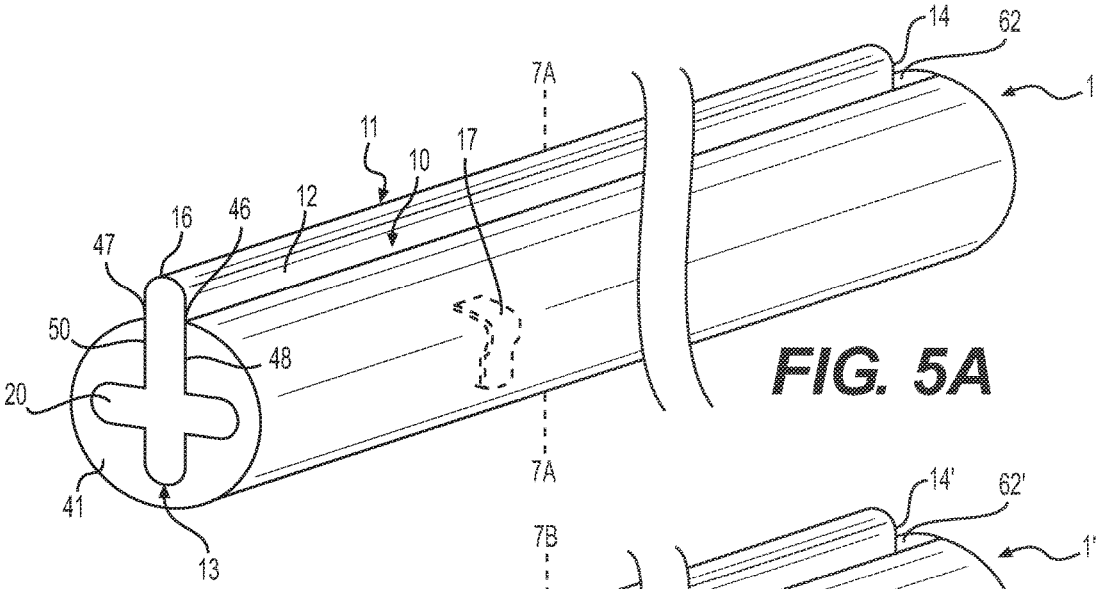
FIG. 5A is a top perspective view of the male and female components of the invention in the first embodiment mated.
Figure 5B:
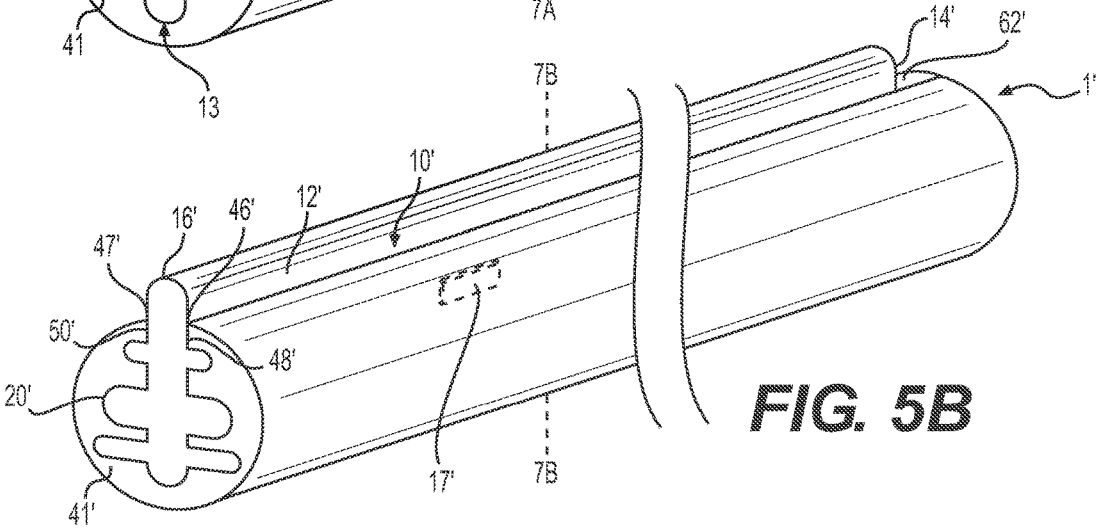
FIG. 5B is a top perspective view of the male and female components of the invention in the second embodiment mated.
Figure 6:
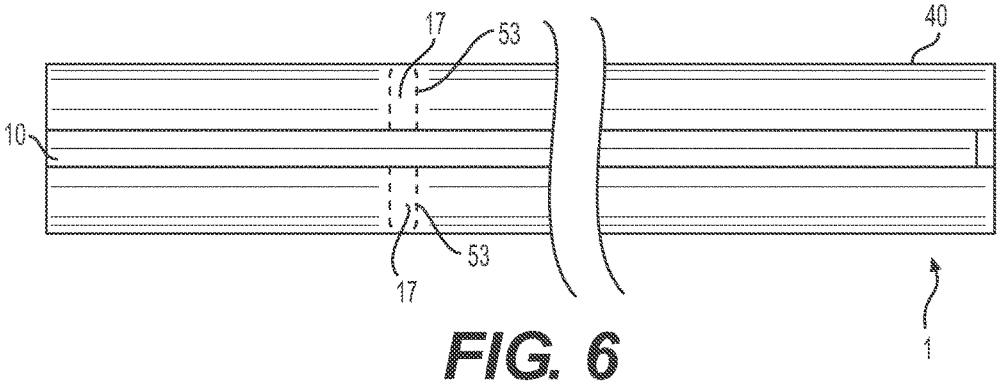
FIG. 6 is a top view of the male and female components of the invention in the first embodiment mated with portions of the retaining mechanism shown in phantom.

Referring to FIGS. 5A-5B, the male component 10/10' can be forced into the internal space 54/54' of the female component 40/40'. The internal surface 58 includes edges 66, 68, 70, 72, which are dimensioned to mate with edge 19, 21, 23, 25, as is best illustrated in FIGS. 5A, 6 and 7A. The retaining member or bump 17/17' is slotted into the groove 53/53' ideally such that the face of the male member 10/10' engages the stop surface 64/64', thereby creating a locked configuration. In this way, the fastening structure 1/1' mates together to avoid radial tension, but allows for sliding movement in one direction only, although some friction where the retaining mechanism 17/17' mates with the groove 53/53' may have to be overcome. It is foreseen that the fastener 1/1' may not include a retaining mechanism 17/17' or a groove 53/53'.

By avoiding a too tight fit relationship when the male member 10/10' is received within the female member 40/40', it will be appreciated that the female member 40/40' can slide about the longitudinal length L/L' of the male member 10/10' or vice versa. On the other hand, the clearance between these members 10/10', 40/40', when engaged, cannot be excessive because control would be lost over the movements of the either component 10/10', 40/40' which could inadvertently slide along and out of the respective component 40/40', 10/10'. Therefore, a close fit or friction fit that provides some contact and friction is preferable. However, by ensuring that an internal surface 58/58' of the internal slot 54/54' of the female component 40/40' and an external surface 60/60' of the male component 10/10' are smooth, with the appropriate relative dimensions, the two members can slide easily relative to each other without binding. For example, the male and female components 10/10', 40/40' can be extruded polyethylene.

It is foreseen that one of the semi-cylindrical half portions 48, 50 may be resilient or deformable, although in the embodiment being described above, it is understood they are all resilient. If the female component 40 is deformable, this would allow for a snap on coupling rather than a slide on coupling.

Referring to FIGS. 3B and 4B, a third embodiment of the present invention is illustrated. The male member 110 is envisioned to be substantially similar to member 10 with these exceptions. In this embodiment, a male member 110 includes an elongate wing member 112 and a bulbous circular portion 120 having an outer surface 160. The female member 140 is envisioned to be substantially similar to female member 40 with these exceptions. In this embodiment, a female member 140 includes an elongate slot 152 and a circular slot, groove, aperture 156 defining an inner chamber 158 that is sized and shaped to mate (not shown) with the circular portion 120 of the male member 110.

It is foreseen that a plurality of fasteners may be provided, each of the fasteners comprising a male portion and a female portion as set forth above, and situated about a plane (not shown) to slideably mate with a mating plurality of fastener structures that situated about a second plane (not shown).

Figure 8:
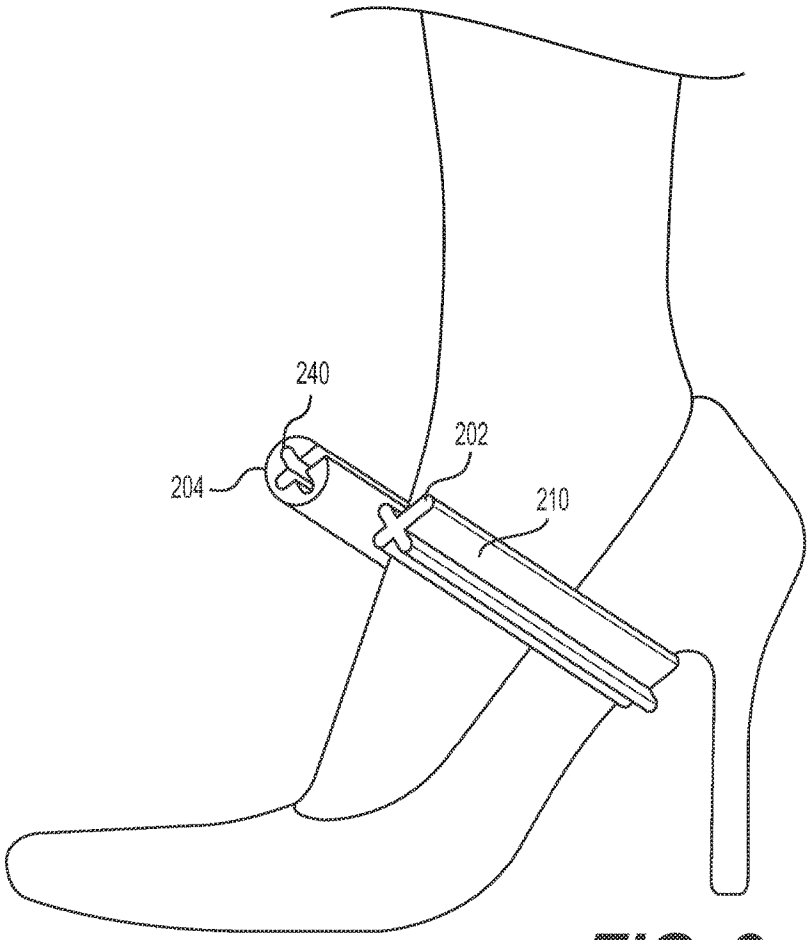
FIG. 8 is a top perspective view of the male and female components in use with a shoe strap uncoupled.
Figure 9:
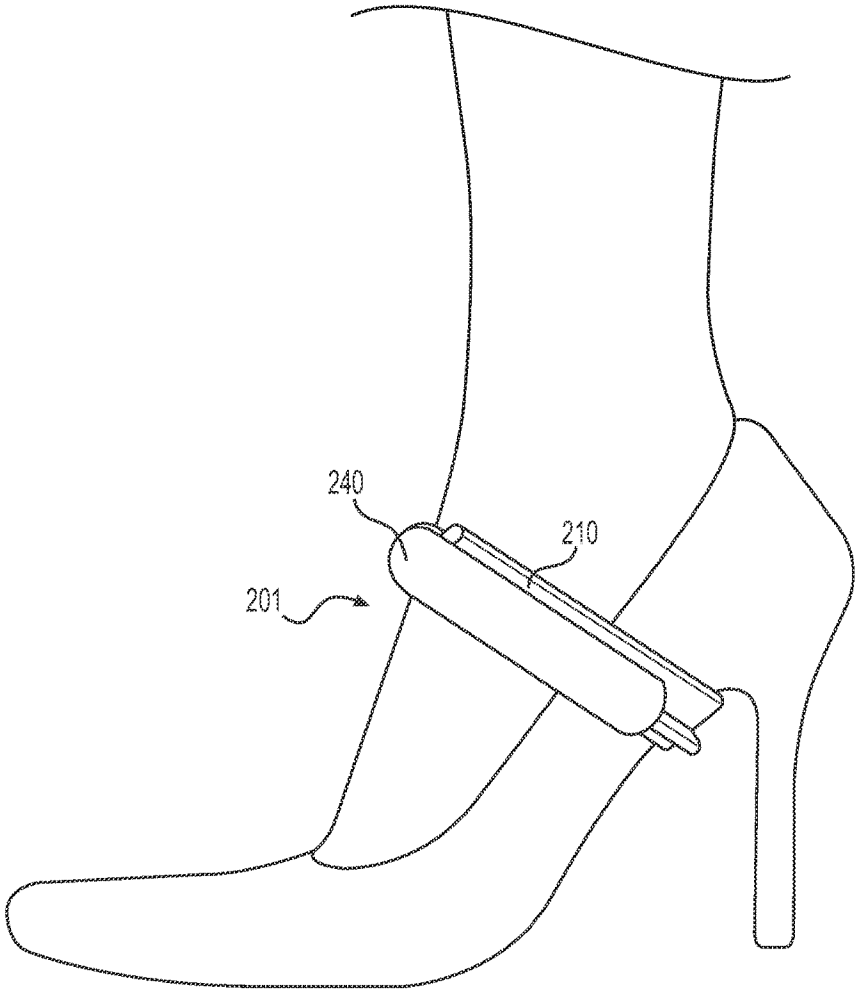
FIG. 9 is a top perspective view of the male and female components in use with a shoe strap coupled.

Referring to FIGS. 8-9, an illustrated example of the fastener structure is shown in conjunction with a shoe strap 201 on a shoe 200. The male portion 210 is attached to an end 202 of the shoe strap 201. It is foreseen that the whole strap from beginning (not shown) to end 202 could be in the shape of the male component. The female portion 240 is attached to an opposed end 204 of the shoe strap 201. In FIG. 8, the male component 210 is inserted through the female component 240 such that the two components 210, 240 are coupled and connected. It also foreseen that the strap may be located anywhere on the shoe 200 and not limited to near the toe section. It is foreseen that the male component 210 may be interchanged with the female component 240 and vice versa.

Figure 11:
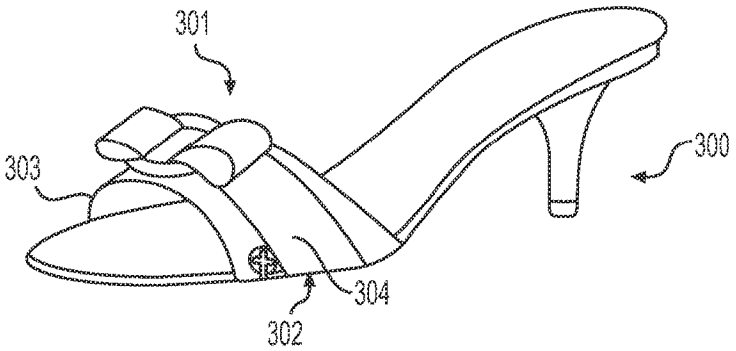
FIG. 11 is a top perspective view of the male and female components coupled in use with a shoe decoration assembled with a shoe.
Figure 10:
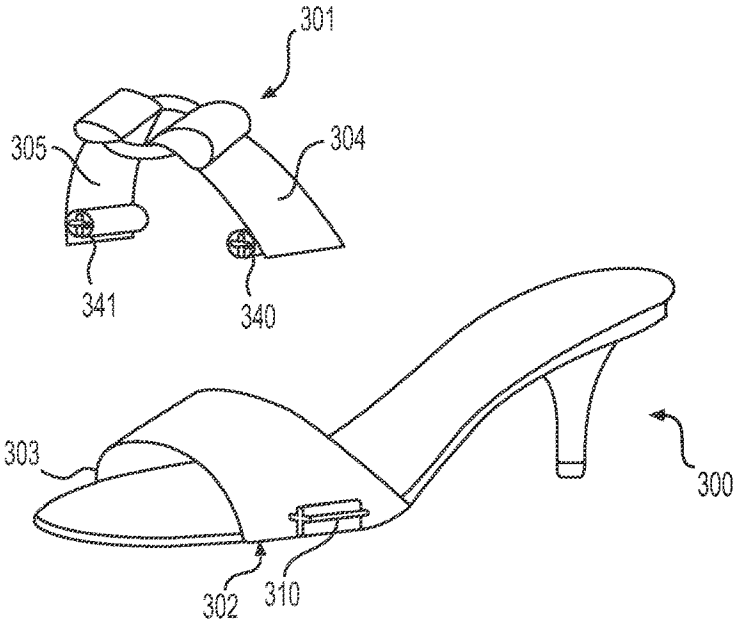
FIG. 10 is a top perspective view of the male and female components in use, with a shoe having the male component and a shoe decoration having the female component.
Figure 12:
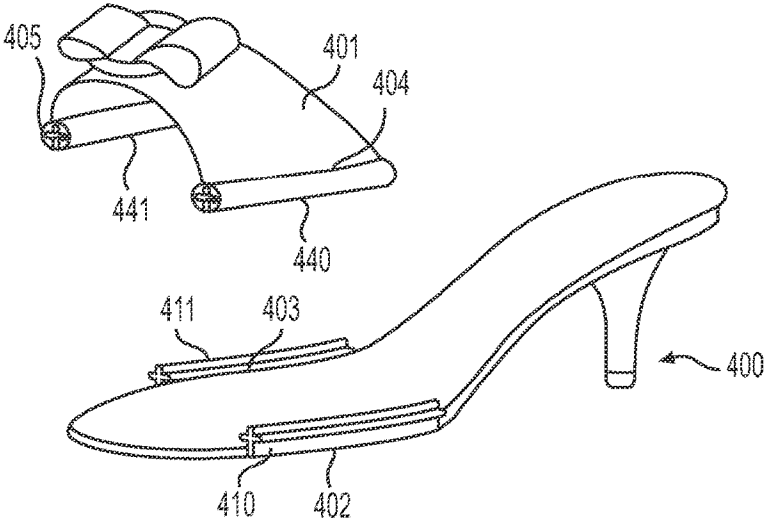
FIG. 12 is a top perspective view of the male and female components in use, with a shoe having the male component attached to the sole and a strap having the female component.
Figure 13:
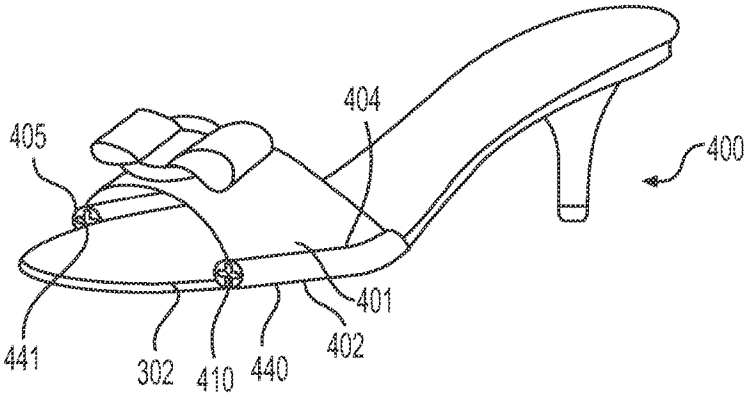
FIG. 13 is a top perspective view of the male and female components coupled in use with the shoe assembled with the shoe strap.

Referring to FIGS. 9-10, an illustrated example of the fastener structure is shown in conjunction with a shoe 300. Male components or portions 310, 311 are attached (i.e. sewn) to an ends 302, 303 of the shoe strap 301. The female portions or components 340, 341 are attached (i.e. sewn) to opposed sides 304,305 along a length of the shoe strap decoration 301. In the illustrated embodiment the shoe strap decoration is a bow, but the illustrated example is not meant to be limiting on the shoe decorations, which may further include ribbons, fluffs, mirrors, wisps, fringe, pearls, semi-precious stones or metals, precious stones or metals, or the like, etc. In FIG. 10, the male components 310, 311 are inserted through the respective female components 340, 341, such that the two components 310, 340 and 311, 341 are coupled and connected. It is foreseen that the male component 310, 311 or male components 310, 311 may be interchanged with female components 340,341 and vice versa. It also foreseen that the strap may be located anywhere on the shoe 300 and not limited to near a toe section as illustrated. The fastener components 310, 311, 340, 341 are oriented along the bottom of shoe decoration 301 and traverse to the length of the shoe 300. It is foreseen that the fastener components 310, 311, 340, 341 may be oriented in a direction along the length of the shoe 300 or side of the shoe decoration 301 (as best seen in FIGS. 11-12). It is foreseen the decorations may also attach to other garments or accessories such as belts, hats, clothing, gear, etc., and should not be limited to shoes.

Referring to FIGS. 11-12, an illustrated example of the fastener structure is shown in conjunction with a shoe 400. Male components or portions 410, 411 are attached (i.e. sewn) to an ends 402, 403 of the shoe strap 401, preferable at the sole. The female portions or components 440, 441 are attached (i.e. sewn) to opposed sides 404, 405 along a side length of the shoe strap 401. In FIG. 12, the male components 410, 411 are inserted through the respective female components 440, 441, such that the two components 410, 440 and 411, 441 are coupled and connected. It is foreseen that the male component 410, 411 or male components 410, 411 may be interchanged with female components 440, 441 and vice versa. It also foreseen that the strap 401 may be located anywhere on the shoe 400 and not limited to near a toe section as illustrated. The fastener components 410, 411, 440, 441 are oriented along a length of the shoe 400 and strap 401. It is foreseen that the fastener components 410, 411, 440, 441 may be oriented in a direction traverse to the length of the shoe 400 or side of the shoe strap 401 (as best seen in FIGS. 8-9).

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations may be of utility and may be employed within the scope of the disclosure. Further, various steps set forth herein may be carried out in orders that differ from those set forth herein without departing from the scope of the present methods. This description shall not be restricted to the above embodiments.

It is to be understood that while certain forms of the present invention have been illustrated and described herein, it is not to be limited to the specific forms or arrangement of parts described and shown.

What is claimed is as follows:

1. A fastening structure for fastening a plurality of objects to each other, the fastening structure comprising:

a first slideable component having an elongate length about a longitudinal axis and having a front face at an end of the elongate length, the first slideable component comprising:

a first member extending along the elongate length and having first and second opposed sides;

a second member extending substantially perpendicularly from the first member first side along the elongate length; and a third member extending substantially perpendicularly from the first member second side along the elongate length;

a second slideable component being elongate about the longitudinal axis and having a front face at an end thereof, an elongate slot and a cross groove being laterally situated from the elongate slot, each of the slot and groove extending along a length about the longitudinal axis;

wherein:

a first space is defined between the first side of the first member and a top side of the second member;

a second space is defined between the first side of the first member and a bottom side of the second member;

a third space is defined between the second side of the first member and a top side of the third member;

and a fourth space is defined between the second side of the first member and a bottom side of the third member; and the first and second slideable components are engaged and slideably movable relative to each other along the respective longitudinal lengths thereof, one of said first and second slideable components receiving the other of said first and second slideable components whereby the first member is situated within the elongate slot, and the second member and the third member are situated within the cross groove to resist separation from each other.

2. The fastening structure of claim 1, wherein the first slideable component is coupled to the second slideable component by force-fitting and is removed therefrom by pulling.

3. The fastening structure of claim 1, wherein the first slideable component is coupled to the second slideable component by snapping on and is removed by snapping off.

4. The fastening structure of claim 1, wherein the first slideable component is coupled to the second slideable component by slide on and is removed by snapping off.

5. The fastening structure of claim 1, wherein the first slideable component is coupled to the second slideable component by slideably mating on and is removed by pulling off.

6. The fastening structure of claim 1, wherein the front face of at least one first and second components is slanted at an angle traverse from longitudinal axis.

7. The fastening structure of claim 1, wherein the first slideable component further includes first and second supplemental members extending along the elongate length, the first and second supplemental members being in communication with the first and second sides of the first member, respectively, and the second slideable component contains a second cross aperture sized and shaped to mate with the first and second supplemental members.

8. The fastening structure of claim 1, wherein the second slideable component further includes a stop situated on an opposed side from the front face, wherein the stop prevents further sliding in a first direction of the first slideable component along the longitudinal axis with respect to the second slideable component.

9. The fastening structure of claim 1, wherein the second slideable component has an outer surface that is circular in dimension.

10. The fastening structure of claim 1, wherein the front face of the first slideable component is inserted into the front face of the second slideable component.

11. The fastening structure of claim 1, wherein at least one of the first and second slideable components further comprise a retaining structure such that the retaining structure mates within a groove on the other respective component such that the first and second slideable components are in a locked configuration.

12. The fastening structure of claim 11, wherein, when in the locked configuration, the fastening structure requires a force along the longitudinal axis to slide the first and second slideable components apart in an unlocked configuration.

13. A shoe strap separate from a shoe, the shoe strap and shoe each having a fastening structure for fastening to each other, the fastening structure comprising:

a first slideable component being elongate about a longitudinal axis and having a front face, an elongate wing member and a cross member being laterally situated from the wing member such that four adjacent spaces are defined, each of the elongate wing member and the cross member extending along a length about the longitudinal axis;

a second slideable component being elongate about the longitudinal axis and having a front face, an elongate slot and a cross groove being laterally situated from the elongate slot, each of the slot and groove extending along a length about the longitudinal axis, and wherein the first and second slideable components being engaged and slideably movable relative to each other along the respective longitudinal lengths thereof, one of said first and second slideable components receiving the other of said first and second slideable components whereby the wing member and cross member are situated within the elongate slot and cross groove to resist separation from each other.

14. The fastening structure of claim 1, wherein the second and the fourth spaces are less than the first and the third spaces.

15. The fastening structure of claim 14, wherein the first and the third spaces are substantially equal.

16. The fastening structure of claim 15, wherein the second and the fourth spaces are substantially equal.

* * * * *